US006895845B2

(12) United States Patent
Snyder

(10) Patent No.: US 6,895,845 B2
(45) Date of Patent: May 24, 2005

(54) ROTARY SHEETER HAVING AN IMPROVED VACUUM MEANS FOR CROSS TRIM REMOVAL

(75) Inventor: Dennis L. Snyder, Dover, PA (US)

(73) Assignee: Advance Graphics Equipment of York, Inc., Dover, PA (US)

( * ) Notice: Subject to any disclaimer, the term of this patent is extended or adjusted under 35 U.S.C. 154(b) by 0 days.

(21) Appl. No.: 10/859,002

(22) Filed: Jun. 2, 2004

(65) Prior Publication Data

US 2004/0244551 A1 Dec. 9, 2004

Related U.S. Application Data

(60) Provisional application No. 60/476,240, filed on Jun. 6, 2003.

(51) Int. Cl.[7] ..... B26D 7/06
(52) U.S. Cl. ..... 83/100; 83/349
(58) Field of Search ..... 83/24, 98, 100, 83/165, 167, 343–6, 349

(56) References Cited

U.S. PATENT DOCUMENTS

| | | | | |
|---|---|---|---|---|
| 4,037,501 | A | | 7/1977 | Gladow |
| 4,080,856 | A | | 3/1978 | Shearon |
| 4,113,243 | A | | 9/1978 | Gregoire et al. |
| 4,409,870 | A | * | 10/1983 | Rynik et al. ..... 83/100 |
| 4,441,703 | A | | 4/1984 | Faltin |
| 4,452,114 | A | | 6/1984 | Rynik et al. |
| 4,524,658 | A | | 6/1985 | Focke et al. |
| 4,565,363 | A | | 1/1986 | Faltin |
| 4,566,687 | A | | 1/1986 | Faltin |
| 4,678,172 | A | | 7/1987 | Faltin |
| 4,792,077 | A | | 12/1988 | Faltin |
| 4,799,414 | A | | 1/1989 | Scheffer et al. |
| 4,962,683 | A | | 10/1990 | Scheffer et al. |
| 5,127,292 | A | * | 7/1992 | Kapoor ..... 83/24 |
| 5,140,880 | A | | 8/1992 | Littleton |
| 5,199,341 | A | | 4/1993 | Jones |
| 5,437,213 | A | | 8/1995 | Schulz |
| 5,609,084 | A | | 3/1997 | Gronbjerg |
| 5,762,596 | A | | 6/1998 | Dittli |
| 5,950,510 | A | | 9/1999 | Scheffer et al. |
| 5,957,050 | A | | 9/1999 | Scheffer et al. |
| 6,349,933 | B1 | | 2/2002 | Scheffer et al. |
| 6,494,452 | B1 | | 12/2002 | Karasiewicz |

* cited by examiner

*Primary Examiner*—Allan N. Shoap
*Assistant Examiner*—Carolyn Blake
(74) *Attorney, Agent, or Firm*—Stuart J. Friedman

(57) ABSTRACT

Apparatus for continuously cutting a web and removing trim strips therefrom, including a pair of circumferentially spaced knives supported on a cutting shaft, the shaft being rotationally mounted for cutting, in a cutting area, the web transverse to its direction of movement for forming trim strips, a cylinder mounted along the underside of the web for rotation about an axis which is generally perpendicular to the direction of the moving web, the cylinder having a hollow bore communicating with a low pressure source and an opening formed in the surface of the cylinder communicating with the bore for providing low pressure at the opening, the cylinder being rotated at a predetermined speed such that the opening is positioned in the cutting area immediately downstream of the knives each time a trim strip is cut from the web and the opening is rotated away from the cutting area immediately thereafter.

26 Claims, 4 Drawing Sheets

ROTARY SHEETER HAVING AN IMPROVED VACUUM MEANS FOR CROSS TRIM REMOVAL

CROSS-REFERENCE TO RELATED APPLICATIONS

This is a non-provisional application based upon U.S. provisional application Ser. No. 60/476,240, filed Jun. 6, 2003, now pending.

FIELD OF THE INVENTION

The present invention relates to apparatus for cutting and removing trim strips from a printed web and, more particularly, to an apparatus which will cut trim strips from a moving printed web in a continuous manner and remove the trim strips from the cutting area using air flow.

BACKGROUND OF THE INVENTION

In early web product processing systems, the web coming from a web press was simply cut into sheets of uniform size, stacked, and sent to a bindery where further operations would take place on the sheets, including further cutting, trimming, gluing, and folding. Technological advancements in the field have simplified the processing of web products by incorporating the slitting, trimming, and folding operations as functions carried out at the exit end of the web press on the printed web, while the web is continuously moving. These advancements have provided a significantly more efficient, economical and less labor intensive method for processing web products.

Today, modern trim strip cutting machines play an important role in the printed web finishing process. On occasion it is sufficient to cut the printed web in one or more places to form a finished web product. For example, the printing rollers of the press may print one or several identical images on the web during one revolution. These images would then be cut so that the final web product has only one image. However, it is commonly found that at the lines of intersection of these images, a bleed area forms which is somewhat unsightly and which should be removed. Furthermore, there is always a non-printed area formed in each revolution of the printing press, due to the lock-up mechanism holding the two ends of the printing plate or blanket wrapped around the plate or blanket cylinder. For these purposes, it is not sufficient simply to cut the web. Rather a small strip, variously referred to as a slug, chip, trim strip or cross trim, has to be removed, consisting of this bleed area or a gap covering the non-printed area. The strips cut from the web must be quickly and efficiently removed from the area of the cutting knives to prevent fouling of the cutting blades and clogging of the cutting area. Various web processing apparatuses have been developed with means for removing these strips. However, such apparatuses have proven to be functionally and/or economically inefficient, by failing to prevent clogging of the cutting area and or requiring expensive and/or numerous mechanically operated components.

It is well known, for example from U.S. Pat. No. 4,037,501—Gladow and U.S. Pat. Nos. 4,409,870 and 4,452,114, both to Rynik, to cut trim strips from printed webs using an axially rotatable cutting cylinder having a pair of spaced apart, trim strip-cutting knives mounted on the periphery thereof and to remove the cut trim strip by providing a low pressure source within a hollow portion of the cutting cylinder communicating with an opening between the knives, such that ambient air in the cutting area establishes an air flow from the cutting area through the opening between the knives into the reduced pressure hollow portion of the cutting cylinder, the air flow carrying the cut trim strip out of the cutting area into the hollow of the cylinder. A disadvantage of this type of apparatus is that it is expensive to build the trim strip removal structure into the interior of the rotatable cutting cylinder. In addition, the opening between the knives is a relatively small space and it is difficult for cut trim strips to pass through it. As a result, the cut trim strips can easily get caught up on and foul the cutting knives or clog the opening and, eventually, impede the cutting ability of the knives and/or cause a shut down of the cutting cylinder.

Another form of gap cutting apparatus, which also uses vacuum means to remove the cut trim strip, disclosed in U.S. Pat. No. 5,199,341—Jones provides a dual rotary knife system wherein the web is first cut by an upstream rotary knife and is subsequently cut by a downstream rotary knife to completely separate the trim strip from the web. Immediately downstream of the second rotary knife is a vacuum operated trim strip removal system positioned below the web which provides alternating vacuum to remove the trim strip and pulsing positive air pressure against the underside of the leading edge of the web. A transverse slot below the web cooperates with the downstream rotary knife to remove the trim strip from the leading edge of the web. A rotary valve controls whether there is vacuum or pulsing positive air pressure at the slot. Slightly before, during and slightly after the trim strip is cut by the downstream rotary knife, the rotary valve is closed so that there is vacuum at the slot which draws air through the top end of the transverse slot for causing the fully cut trim strip to pass through the slot. Immediately thereafter the rotary valve opens to provide pulsing positive air pressure at the slot to prevent the leading edge of the web from following the trim strip into the transverse slot. The disadvantage of this type of arrangement is that it requires both negative and positive air flows at the strip to assure trim strip removal while preventing the leading edge of the web from following the trim strip into the slot.

Notwithstanding these and other efforts to efficiently cut and remove trim strips from printed webs, it should be apparent that efforts to date suffer from one or more shortcomings which make the apparatus unnecessarily complicated, expensive or unreliable in use. Accordingly, there still exists a need for an economical, simple and effective apparatus for removing cut trim strips from a moving printed web to form uniform finished web products.

SUMMARY OF THE INVENTION

It is, therefore, a primary object of the present invention to provide an apparatus for continuously cutting and removing trim strips from a moving web which is economical, simple and effective.

It is also an object of the present invention to provide an apparatus for continuously cutting and removing trim strips from a moving web which removes cut trim strips through the use of a slotted cylinder having a low pressure applied to the slot and which avoids blade fouling and clogging of the cutting area.

It is another object of the present invention to provide an apparatus for continuously cutting and removing trim strips from a moving web which utilizes a rotating slotted hollow cylinder in communication with a low pressure source, the cylinder being positioned downstream of the trim strip cutting knives for removal of the cut trim strips.

It is yet another object of the present invention to provide an apparatus for continuously cutting and removing trim strips from a moving web which utilizes a rotating slotted hollow cylinder in communication with a low pressure source, the cylinder being positioned along the underside of the web for removal of the cut trim strips.

It is still another object of the present invention to provide an apparatus for continuously cutting and removing trim strips from a moving web wherein the slotted hollow cylinder is driven by the shaft mounting the trim strip cutting knives for positioning the slot at the leading edge of the web at the time that the trim strip is cut for immediate and efficient removal of the trim strip via vacuum means in the hollow cylinder communicating with the slot, after which the slot rotates away from the leading edge of the web to avoid drawing the leading edge of the web into the slot.

The foregoing and other objects are achieved in accordance with the present invention by providing an apparatus for continuously cutting a web moving in a plane into predetermined lengths and removing trim strips therefrom, the apparatus comprising:

a cutting shaft mounted for rotation about an axis which is generally perpendicular to the direction of the moving web;

means for rotating the cutting shaft at a predetermined speed;

means for feeding the web to the cutting shaft;

at least one knife means mounted on the cutting shaft for continuously cutting, in a cutting area, the web transverse to its direction of movement for forming trim strips having a predetermined width;

a cylinder mounted for rotation about an axis which is generally perpendicular to the direction of the moving web, the cylinder having a hollow bore communicating with a low pressure source and an opening formed in the surface of the cylinder communicating with the bore for providing the low pressure at the opening; and means for rotating the cylinder at a predetermined speed such that the opening is positioned in the cutting area immediately downstream of the knife means each time the knife means cuts the web for forming a trim strip and the opening is rotated away from the cutting area immediately therafter;

whereby as each trim strip is cut the ambient air in the cutting area creates an air flow toward the lower air pressure within the hollow bore cylinder for sweeping the cut trim strip through the opening into the bore of the cylinder.

In another aspect of the invention, there is provided an apparatus for continuously cutting a web and removing trim strips therefrom wherein the opening in the rotating cylinder is an elongate slot extending axially of the cylinder and the cylinder is positioned along the underside of the web for providing rotary support therefor.

In still another aspect of the invention, there is provided an apparatus for continuously cutting a web and removing trim strips therefrom wherein the knife means comprises one pair of circumferentially spaced apart knives, the hollow cylinder is rotationally driven relative to the cutting shaft at a ratio of two revolutions of the cylinder for each revolution of the cutting shaft and the apparatus includes exit means for engaging the web and moving the web away from the cutting area, the leading edge of the web being engaged by the exit means before the opening communicates with the cutting area during the second revolution of the cylinder for providing a tension on the web preventing the reduced pressure at the opening from drawing a portion of the web upstream of the leading edge into the opening.

In yet another aspect of the invention, there is provided an apparatus for continuously cutting a web and removing trim strips therefrom including an adjustable air port supported by the cutting shaft for directing a flow of compressed air onto the plane of the moving web a short distance upstream of the knife means.

DESCRIPTION OF THE PREFERRED EMBODIMENT

Figure 1:
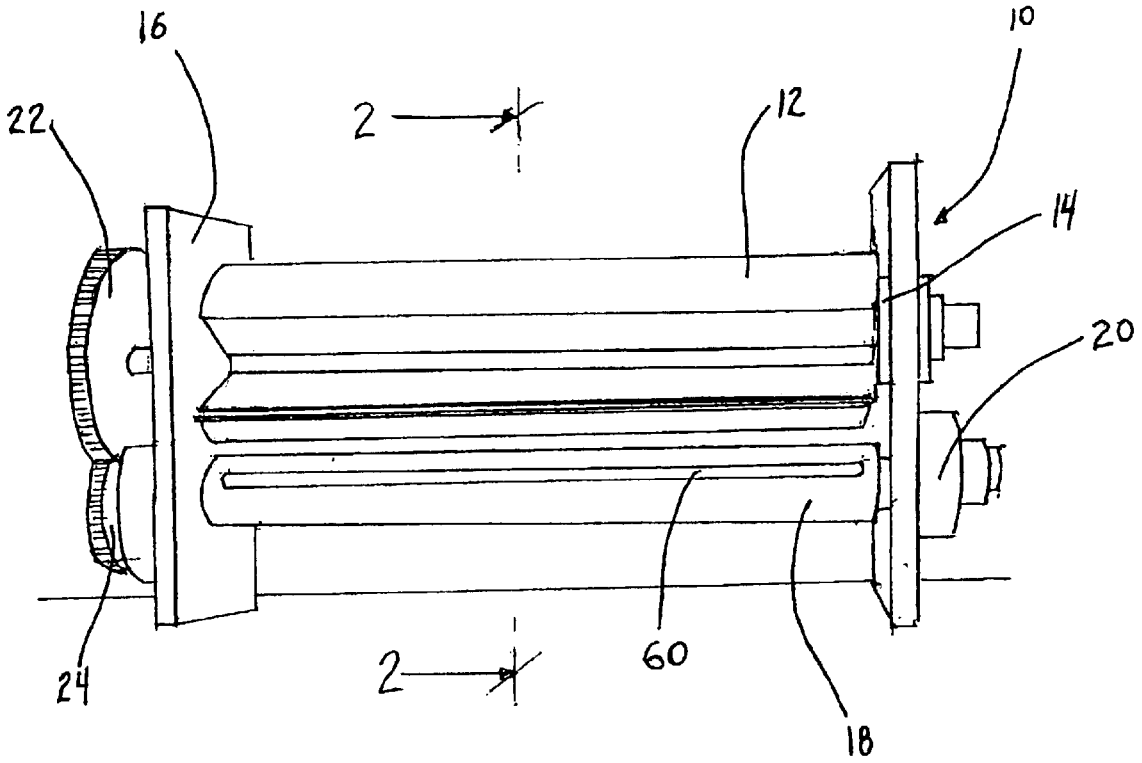
FIG. 1 is a front perspective view of the trim strip cutting and removal apparatus of the present invention showing the rotating knife shaft positioned above the rotating hollow cylinder.
Figure 2:
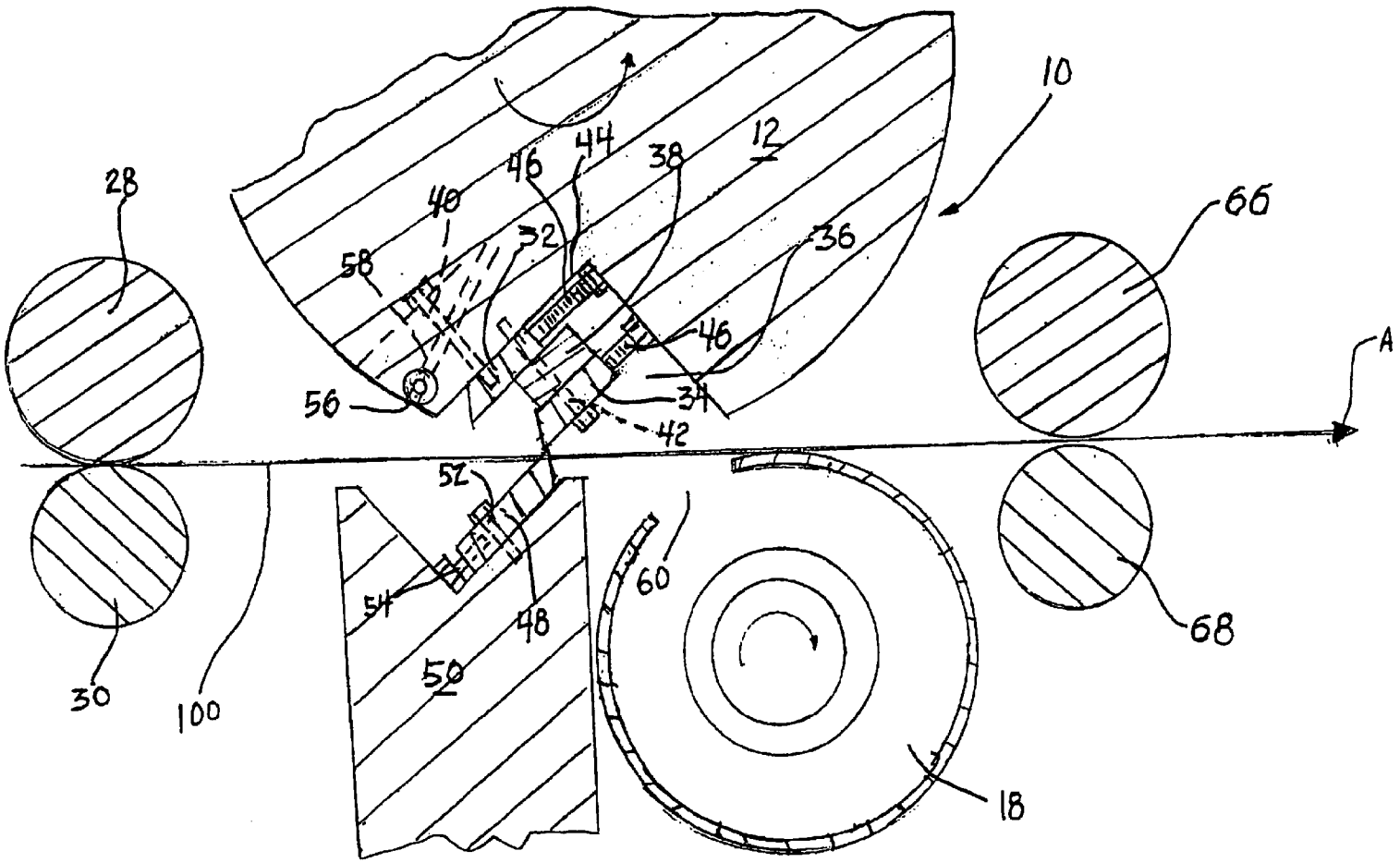
FIG. 2 is an enlarged, partial cross-sectional view taken along the line 2—2 in FIG. 1.
Figure 3:
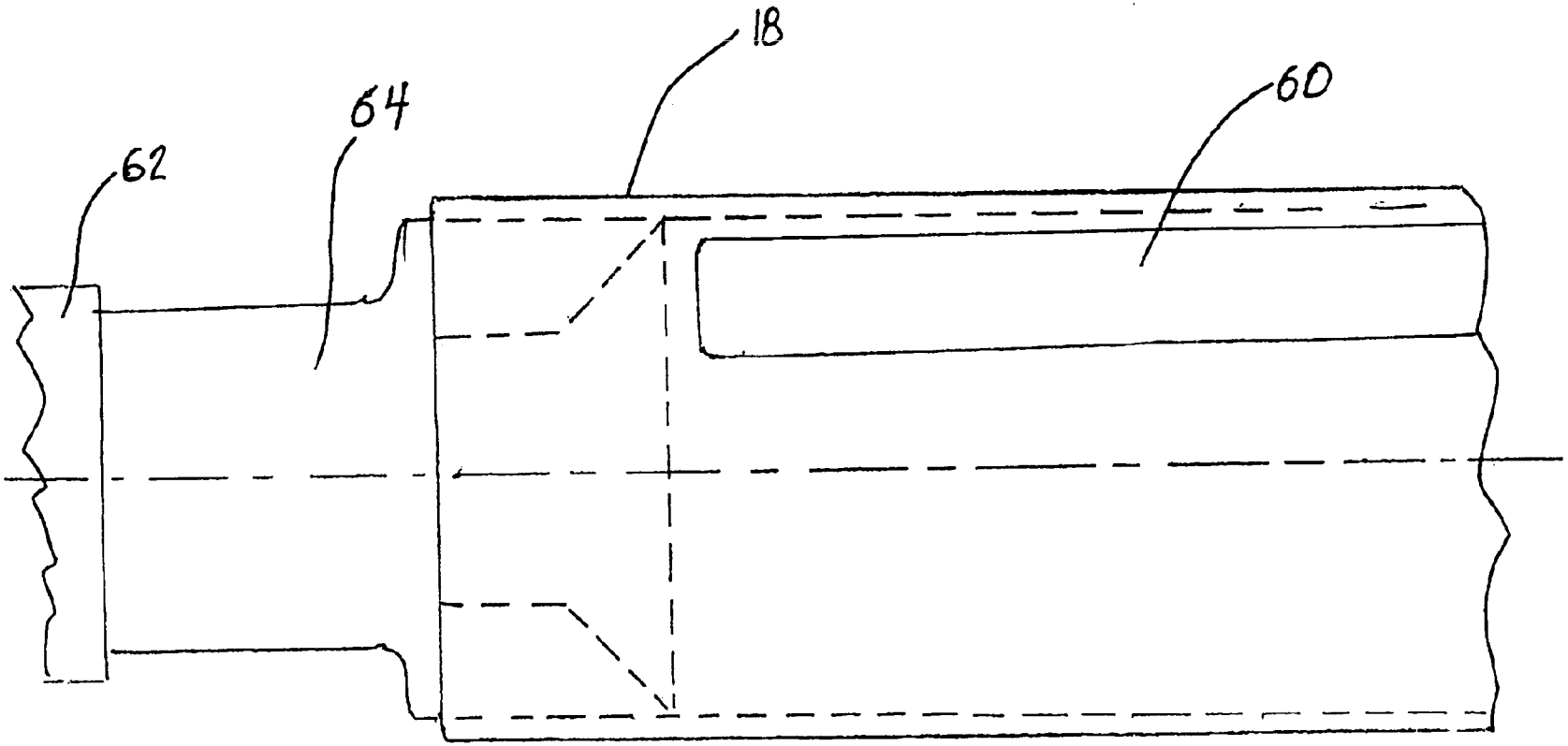
FIG. 3 is a partial front elevational view of the rotating hollow cylinder of the present invention, showing the vacuum source.

The trim strip cutting apparatus 10 of the present invention is illustrated in FIG. 1 and comprises a cutting shaft 12 mounted for rotation on its opposed sides in bearings 14 which are supported by frame 16. Also mounted in frame 16 is a slotted, hollow cylinder 18 mounted for rotation on its opposed sides in bearings 20. A cutting shaft gear 22 is fixed at one end of the cutting shaft 12 to enable the cutting shaft 12 to be driven, through a drive train by an electric motor (not shown). A rotating cylinder gear 24 is fixed at one end of the slotted cylinder 18 and meshes with the teeth on cutting shaft gear 22 to enable the slotted cylinder 18 to be driven by the rotating cutting shaft 12.

Trim strip cutting apparatus 10 is typically positioned in-line with the output end of a rotary web press for cutting printed webs coming off the web press. Any number of post-web press operational units may be positioned between the web press and the trim strip cutting apparatus to prepare the printed web for trim strip cutting, such as folding stations, slitting and trimming stations, and the like. The trim strip cutting apparatus can cut trim strips from a wide variety of cut, slit and folded web sections which may be fed into it, all in an in-line operation with a web press. Any number of post-trim strip cutting apparatus operational units may be positioned downstream of the trim strip cutting apparatus, such as stacking or collecting units.

Referring now to the trim strip cutting apparatus 10 illustrated in FIGS. 1–4, as the web 100, moving in a horizontal plane, approaches the trim strip cutting apparatus 10, it passes between at least one pair of infeed draw nip wheels 28 and infeed draw rollers 30, driven at predetermined speeds, to move the web 100 towards the trim strip cutting apparatus 10 at a desired speed in the direction indicated by the arrow A. Web 100 passes between cutting shaft 12, rotating counterclockwise, positioned above the web and hollow slotted cylinder 18, rotating clockwise, positioned below the web.

At least one pair of spaced knives 32, 34 are mounted in a recess 36 on the cutting shaft 12. A spacer 38 is removably positioned between the knives to maintain the desired spacing or gap between the knives 32, 34, which influences the width of the cut trim strip. To change the width of the trim strip cut, narrower or wider spacers 38 may be used. Each of the knives 32, 34 is held in position in the recess 36 by a separate knife holder bolt 40, 42 which extends generally perpendicularly to the longitudinal extent of the knives 32, 34 and threads into the wall 44 of the recess 36. At least the knife 32 closest to the recess wall 44 includes a slot therein (not shown) to allow passage of bolt 42 therethrough for holding the outside knife 34 within recess 36. Each of the knifes 32, 34 includes a set screw 46 threaded into a bore in the rear of each knife 32, 34 for adjusting the projection of the cutting edge of the knife with respect to the circumference of the cutting shaft 12 and the stationary knife bed knife 48. The latter projects upward from beneath web 100 and is secured in stationary bed 50 via bolt 52 which passes perpendicularly through stationary knife 48 and threads into the wall of the stationary bed 50. Stationary knife 48 includes a set screw 54 threaded into a bore in the rear of stationary knife 48 for adjusting the projection of the cutting edge of the knife with respect to rotary knives 32, 34. As is well known in the art, the cutting edges of the rotary knives 32, 34 are skewed with respect to the axis of the cutting shaft 12 while stationary bed knife 48 is offset laterally across the same rotational axis of the rotating cutting knifes to produce a shearing or scissors cutting action to the web. This type of cutting tends to reduce incomplete web cutting and hang-up of web fibers.

A short distance upstream of the rotating knives 32, 34 an optional adjustable air port 56 formed in the rotating knife shaft 12 permits a flow of compressed air to be directed from a compressed air source (not shown) through a compressed air feed channel 58 onto the plane of the moving web 100. The port 56 is adjustable and rotatable to obtain the desired angle of air flow. This air flow may either be continuous or intermittent and is adjusted in terms of intensity and direction depending upon the differing strength, rigidity and other characteristics of the web substrate (e.g., paper, plastic, coated paper) which influence its ability to maintain a flat plane of travel to the exit nip wheels and draw rollers.

A cut trim strip removal system operates in conjunction with the trim strip cutting aspect of the apparatus. The system includes a rotary hollow cylinder 18 having a trim strip receiving slot 60 formed therein and extending substantially along the axial length of the cylinder 18. Cylinder 18 is positioned below the web 100 and immediately downstream of stationary knife 48 in order to provide an underside rotary support for the web and to permit the slot to be positioned adjacent the leading edge of the web as the trim strip is cut. In a preferred embodiment of the invention, as previously described, cylinder 18 has a rotating cylinder gear 24 fixed at one end thereof which meshes with the teeth on cutting shaft gear 22 to enable the slotted cylinder 18 to be driven by the rotating cutting shaft 12. However, it will be appreciated that, if desired, each of the cutting shaft 12 and the slotted cylinder 18 may be independently driven. A low pressure source 62, e.g., from the input side of a blower (not shown), communicates with the hollow cylinder 18 through a vacuum conduit 64 in order to create a reduced pressure within cylinder 18 and at slot 60 for removing the cut trim strip from the cutting area.

As the web 100 leaves the trim strip cutting apparatus 10, the leading edge of the web passes between at least one pair of exit nip wheels 66 and exit draw rollers 68, driven at predetermined speeds, to move the web 100 away from the trim strip cutting apparatus 10 at a desired speed in the direction indicated by the arrow A.

The invention will be better understood from the following description of the operation of the apparatus. After exiting the web press and any post-web press operational units, the leading edge of the web 100 enters the nip between the nip wheel 28 and the infeed draw roller 30 which drives the web 100 at a predetermined speed toward the trim strip cutting apparatus in the direction indicated by the arrow A. As the web 100 enters the cutting area of cutting shaft 12, which is being driven by an electric motor through cutting shaft gear 22, it is cut transversely by the front (or outside) knife 34, which is mounted to and rotates with the cutting shaft 12, against the stationary knife 48 in a shearing action. Immediately thereafter, the rear (or inside) knife 32 is rotated into contact with the web 100 slightly rearwardly of the first knife cut by the width of the trim strip. The rear knife 32 in conjunction with the stationary knife 48, by shearing action, makes a second transverse cut to form a trim strip and separate the trim strip from the leading edge of the remainder of the web. At the same time, if desired, compressed air flow is directed against the web a short distance upstream of the cutting area from the compressed air source through feed channel 58 and adjustable air port 56. As is well known in the art, the speed of rotation of the cutting shaft 12, and thus of knives 32, 34, is faster than the speed of the printed web as it moves toward the cutting shaft 12, in order to minimize bubbling in the printed web.

The low pressure source 62 through vacuum conduit 64 applies reduced pressure within hollow cylinder 18 and at axially extending slot 60. Hollow cylinder 18 is rotated, either by meshing of its rotating cylinder gear 24 with cutting shaft gear 22, or by independent driving means, in a fashion synchronized to the speed of movement of the web, such that slot 60 is positioned at the trim strip as the second cut to form the trim strip is made. Ambient air pressure existing at the cut trim strip in the cutting area causes air flow toward the lower air pressure within the hollow cylinder 18 and the cut trim strip is swept by the air flow through slot 60 into the interior of hollow cylinder 18 for subsequent disposal. Immediately after the trim strip is swept into slot 60, slot 60 is rotated away from the web such that the leading edge of the web, which is also supported along its underside by rotating hollow cylinder 18, does not tend to be drawn into slot 60. In instances where the cylinder 18 is driven relative to the cutting shaft 12 at a ratio of two revolutions (or more) of the cylinder 18 for each revolution of the cutting shaft 12, but only one knife pair is mounted on the cutting shaft, before the rotating hollow cylinder 18 makes a complete revolution to again bring slot 60 into proximity to the underside of the web 100, the leading edge of the web 100 is introduced to the nip between the exit nip wheel 66 and the exit draw roller 68. The web 100 is, thereby, continuously being pulled forward, providing a tension on the web and preventing the low pressure in the rotating hollow cylinder from drawing a portion of the web upstream of the leading edge into slot 60. In order to facilitate this, the exit nip wheel and exit draw roller are driven at a speed greater than the speed of the web and greater than the circumferential speed of either the cutting shaft 12 or the hollow cylinder 18.

The cut trim strip removal system of the present invention efficiently and effectively removes cut trim strips from the cutting area. By utilizing a vacuum-type low pressure cut trim strip removal system in a hollow cylinder positioned immediately downstream of the cutting area and along the underside of the web, the present system is not subject to cut trim strips fouling the knives while trying to negotiate the narrow opening between the knife pair into the interior of the hollow cutting cylinder, as in many prior art devices.

Figure 4:
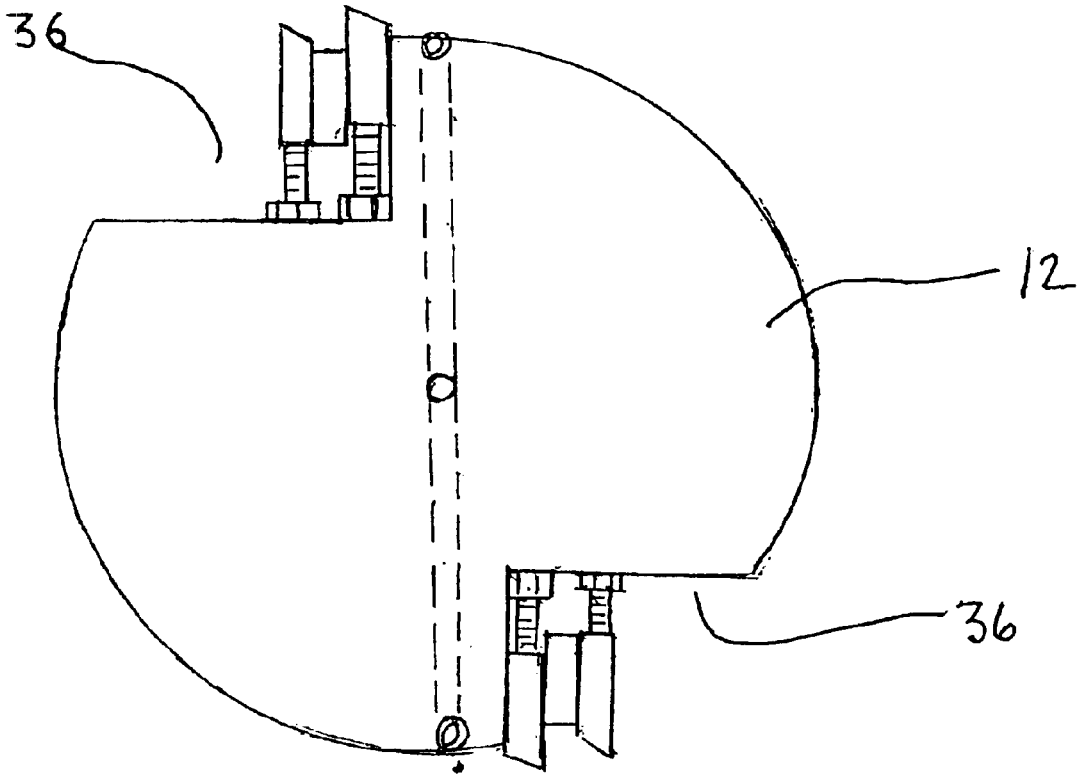
FIG. 4 is a side elevational view of the rotating knife shaft supporting two double knife sets.

The cutting shaft 12 can have one or more pairs of knives to cut cross trim from the web at desired intervals. As can be seen in FIG. 4, which is looking axially along the cutting shaft 12 from one end thereof, there is illustrated an embodiment in which two pairs of knives are mounted in recesses 36 at 180° spaced intervals on the cutting shaft 12. Each of the knife pairs is mounted in a recess 36 in the manner hereinbefore described and, therefore, no further description thereof is required. It will be appreciated that the number of double knife sets on a cutting shaft is normally one or two, but can be more depending on the cutting shaft circumference and the desired number of web cut lengths per revolution of the cutting shaft.

In certain embodiments of the present invention, the hollow cylinder 18 is driven from the cutting shaft 12 by a set of gears to provide rotation, direction of rotation and ratio of rotation relative to the cutting shaft 12. The ratio of rotation of the hollow cylinder 18 to the cutting shaft 12 is dependent on the number of double knife sets mounted on the cutting shaft 12. When, for example, one double knife set is used on a rotary cutting shaft to produce a single trim strip, the gearing to the hollow shaft 18 is one revolution of the cutting shaft 12 to two revolutions of the hollow shaft 18. This arrangement will cause slot 60 in the hollow shaft 18 to be in position to receive the cut trim strips once as the leading edge of the web is being introduced to the cutting area that produces the cut trim strip, and a second time halfway through the travel of the full length of the web to be cut into a sheet. As previously discussed, the apparatus is arranged such that the web is introduced to the downstream exit draw roller and nip wheel before the hollow cylinder 18 is in position to receive the trim strips for the second time. The exit draw roller and nip wheel 66, 68 pull the web forward, providing a tension on the web sufficient to prevent the low pressure applied by the hollow cylinder 18 through slot 60 from drawing an intermediate section of the web into slot 60 and, thus, from hindering the travel of the web through the apparatus.

When two double knife sets are used on the rotary knife shaft 12 to produce two trim strips, the gearing to the hollow cylinder 18 is also one revolution of the rotary knife shaft 12 to two revolutions of the hollow cylinder 18. This will cause the slot 60 in the hollow cylinder 18 to be in position to receive the cut trim strips once at each double knife set position. When three double knife sets are used on the rotary knife shaft 12 to produce three cut trim strips, the gearing to the hollow cylinder 18 is one revolution of the rotary knife shaft 12 to three revolutions of the hollow cylinder 18. This same ratio relationship is applied where four or more double knife sets are employed.

When the hollow cylinder 18 is being driven from the cutting shaft 12, the circumferential length of the outside diameter of the hollow cylinder 18 relative to the cut length of the web 100 is important to the operation of the apparatus. This is because the precise positioning of the slot 60 to efficiently and effectively capture the cut trim strip is, at least in part a function of the type and weight of the paper comprising the web, the humidity content of the web, the air flow conditions in the cutting area, and several other factors. In order to be absolutely sure that, in any particular case, the positioning of the slot 60 relative to the leading edge of the web can be adjusted, the circumferential length of the outside diameter of the hollow cylinder 18 should be greater than the cut length of the web. This means that, paper type and air flow conditions aside, the hollow cylinder will rotate faster than the next advancing leading edge of the web. If such a speed of rotation is too rapid and will result, with paper type and air flow conditions taken into consideration, in slot 60 being positioned too far downstream to effectively capture the cut trim strip, then the speed of rotation of the hollow cylinder 18 can be adjusted, as needed, to properly position the slot 60 to effectively capture the cut trim strip. However, if the paper type and air flow conditions are such that the cut trim strip does not immediately get swept into slot 60, then either no speed adjustment or a lesser speed adjustment might be appropriate. Stated otherwise, by making the circumferential length of the outside diameter of the hollow cylinder 18 slightly greater than the cut length of the web, a safety factor is built in which allows the operator of the apparatus to take into account paper type and air flow conditions and adjust the position of slot 60 relative to the leading edge of the web by adjusting the speed of rotation of cutting shaft 12 and, hence of hollow cylinder 18. For example, if the cut length of the web being fed is twelve inches, it has been found advantageous to make the circumferential length of the outside diameter of the hollow cylinder about twelve and one-half inches, or greater.

While the present invention has been described in terms of specific embodiments thereof, it will be understood that no limitations are intended to the details of construction or design other than as defined in the appended claims.

What is claimed is:

1. An apparatus for continuously cutting a web moving in a plane into predetermined lengths and removing trim strips therefrom, said apparatus comprising:

a cutting shaft mounted for rotation about an axis which is generally perpendicular to the direction of the moving web;

means for rotating said cutting shaft at a predetermined speed;

means for feeding said web to the cutting shaft;

at least one knife means mounted on said cutting shaft for continuously cutting, in a cutting area, said web transverse to its direction of movement for forming trim strips having a predetermined width;

a cylinder mounted for rotation about an axis which is generally perpendicular to the direction of the moving web, said cylinder having a hollow bore communicating with a low pressure source and an opening formed in the surface of said cylinder communicating with said bore for providing said low pressure at said opening; and means for rotating said cylinder at a predetermined speed such that said opening is positioned in said cutting area immediately downstream of said knife means each time said knife means cuts said web for forming a trim strip and said opening is rotated away from said cutting area immediately thereafter;

whereby as each trim strip is cut the ambient air in the cutting area creates an air flow toward the lower air pressure within said hollow bore cylinder for sweeping said cut trim strip through said opening into the bore of said cylinder.

2. An apparatus, as claimed in claim 1, wherein said knife means comprises at least one pair of knives, each knife of said pair being spaced apart from said other knife of said pair along said cutting shaft to define a gap therebetween, said gap influencing the width of the cut trim strip.

3. An apparatus, as claimed in claim 2, wherein said at least one pair of knives is positioned above and extending downwardly into rotating contact with said web and a stationary knife is positioned below and extending upwardly into contact with said web, whereby each of said pair of rotating knives, in turn, cuts said web transversely against said stationary knife in a shearing action.

4. An apparatus, as claimed in claim 1, wherein said cutting shaft is driven at a circumferential speed which is greater than the speed of the moving web.

5. An apparatus, as claimed in claim 1, wherein said opening in said cylinder comprises an elongate slot extending axially of said cylinder.

6. An apparatus, as claimed in claim 1, wherein said cylinder is positioned along the underside of said web for providing rotary support therefor.

7. An apparatus, as claimed in claim 1, further including exit means for engaging said web and moving said web away from said cutting area.

8. An apparatus, as claimed in claim 1, wherein said means for rotating said cylinder comprises drive means operatively connected to said cutting shaft.

9. An apparatus, as claimed in claim 2, wherein said knife means comprises at least two pair of knives along said cutting shaft.

10. An apparatus, as claimed in claim 2, wherein said knife means comprises two pair of knives spaced apart by 180° along said cutting shaft.

11. An apparatus, as claimed in claim 2, wherein said knives of each knife pair are adjustable towards and away from each other for adjusting the width of the gap therebetween.

12. An apparatus, as claimed in claim 1, including means supported by said cutting shaft for directing a flow of compressed air onto the plane of the moving web a short distance upstream of said knife means.

13. An apparatus, as claimed in claim 12, wherein said means for directing a flow of compressed air comprises an adjustable air port for directing the flow of air at a predetermined angle relative to said moving web.

14. An apparatus, as claimed in claim 2, wherein said knife means comprises one knife pair and said cylinder is driven relative to said cutting shaft at a ratio of two revolutions of said cylinder for each revolution of said cutting shaft.

15. An apparatus, as claimed in claim 2, wherein said knife means comprises two sets of knife pairs and said cylinder is driven relative to said cutting shaft at a ratio of two revolutions of said cylinder for each revolution of said cutting shaft.

16. An apparatus, as claimed in claim 2, wherein said knife means comprises n sets of knife pairs and said cylinder is driven relative to said cutting shaft at a ratio of n revolutions of said cylinder for each revolution of said cutting shaft.

17. An apparatus, as claimed in claim 14, including exit means for engaging said web and moving said web away from said cutting area, the leading edge of said web being engaged by said exit means before said opening communicates with said cutting area during the second revolution of said cylinder for providing a tension on said web preventing the reduced pressure at said opening from drawing a portion of said web upstream of said leading edge into said opening.

18. An apparatus, as claimed in claim 17, wherein said exit means comprises driven wheels or rollers and said wheels or rollers are driven at a circumferential speed greater than the circumferential speeds of said cutting shaft and said cylinder and greater than the speed of said web.

19. An apparatus, as claimed in claim 1, wherein the circumferential length of the outside diameter of said cylinder is greater than the cut length of the web.

20. An apparatus, as claimed in claim 1, wherein said cylinder is positioned relative to said cutting shaft and said web such that said opening communicates with said cutting area at least once during each revolution of said cylinder.

21. In an apparatus for continuously cutting a web moving in a plane into individual sheets using a knife means mounted on a rotating shaft and for removing a trim strip between each sheet and the leading edge of the remainder of the web, the improvement comprising:

a cylinder mounted for rotation about an axis which is generally perpendicular to the direction of the moving web, said cylinder having a hollow bore communicating with a low pressure source and an opening formed in the surface of said cylinder communicating with said bore for providing said low pressure at said opening; and means for rotating said cylinder at a predetermined speed such that said opening is positioned in said cutting area immediately downstream of said knife means each time said knife means cuts said web for forming a trim strip and said opening is rotated away from said cutting area immediately thereafter;

whereby as each trim strip is cut the ambient air in the cutting area creates an air flow toward the lower air pressure within said hollow bore cylinder for sweeping said cut trim strip through said opening into the bore of said cylinder.

22. An apparatus, as claimed in claim 21, wherein said opening in said cylinder comprises an elongate slot extending axially of said cylinder.

23. An apparatus, as claimed in claim 21, wherein said cylinder is positioned along the underside of said web for providing rotary support therefor.

24. An apparatus, as claimed in claim 21, further including exit means for engaging said web and moving said web away from said cutting area.

25. An apparatus, as claimed in claim 21, wherein said means for rotating said cylinder comprises drive means operatively connected to said cutting shaft.

26. An apparatus, as claimed in claim 21, wherein said cylinder is positioned relative to said cutting shaft and said web such that said opening communicates with said cutting area at least once during each revolution of said cylinder.

* * * * *